US008070661B2

(12) United States Patent
Tao

(10) Patent No.: US 8,070,661 B2
(45) Date of Patent: Dec. 6, 2011

(54) METHOD OF MAKING A FOLDABLE PACKING BOX

(76) Inventor: Jian Tao, Shen Zhen (CN)

( * ) Notice: Subject to any disclaimer, the term of this patent is extended or adjusted under 35 U.S.C. 154(b) by 328 days.

(21) Appl. No.: 12/484,228

(22) Filed: Jun. 14, 2009

(65) Prior Publication Data

US 2010/0317499 A1 Dec. 16, 2010

(51) Int. Cl.
*B31B 49/02* (2006.01)

(52) U.S. Cl. ..... 493/89; 493/67; 493/84; 493/114

(58) Field of Classification Search ..... 493/67, 493/84, 114, 128, 136, 137, 139, 343, 344, 493/374, 379, 383, 390, 89
See application file for complete search history.

(56) References Cited

U.S. PATENT DOCUMENTS 1,265,273 A * 5/1918 Stokes et al. ..... 229/87.18
2,119,058 A * 5/1938 Richardson ..... 53/440
2,554,004 A * 5/1951 Bergstein ..... 493/88
3,363,824 A * 1/1968 Murata ..... 206/511
5,390,847 A * 2/1995 Young ..... 229/122.21
2008/0314896 A1* 12/2008 Shellhorn et al. ..... 220/6

* cited by examiner

*Primary Examiner* — Hemant M Desai
(74) *Attorney, Agent, or Firm* — Weiner & Burt, P.C.; Irving M. Weiner; Pamela S. Burt

(57) ABSTRACT

A method of making a foldable packing box comprising the following steps: step 1, making a pair of side boards with a side board body, two connecting parts foldably connected to the opposite sides of the side board body, and an installation part foldably connected to the side board body; step 2, making a base board, step 2 including: step 2.1, providing a second core board in a predetermined shape with an outer layer paper being pasted at the outer surface of the second core board; step 2.2, spraying paint to the peripheral surface of the second core board; step 2.3, defining a plurality of parallel base board grooves at the inner surface of the second core board according to the size of the predetermined packing box, so as to separately form a plurality of folding lines at the base board; step 3, respectively connecting the installation parts of the side boards to the opposite sides of the base board; step 4, pasting inner layer paper to the inner surface of the second core board; step 5, providing two fixing boards; and step 6, separately fixing the fixing boards to the base board, so as to produce a finished product of the foldable packing box.

10 Claims, 2 Drawing Sheets

METHOD OF MAKING A FOLDABLE PACKING BOX

FIELD OF THE INVENTION

The present invention relates to a method of making a packing box, and particularly relates to a method of making a foldable packing box.

BACKGROUND OF THE INVENTION

Packing boxes are often used to pack food, cosmetic, stationery and decoration. When a packing box is made, the packing box has a fixed volume. The packing box will occupy the same space whether the packing box receives goods or not. Therefore, the conventional packing box needs large space to store and transport, which increases cost of storage and transportation.

To solve the above mentioned problems of packing boxes, a foldable packing box has been provided. The conventional foldable packing box includes a plurality of foldable connecting boards. During transportation, the connecting boards are folded to locate at a same plane for saving space, so as to reduce transportation cost. The conventional foldable packing box is usually made of a comparatively thin single layer paper board through cutting a whole piece of paper board and then forming folding lines according to the shape of the box. However, this kind of foldable packing box made of a comparative thin single layer paper board is not fit to receive comparatively heavy goods. So, it is necessary to design a kind of foldable packing box made of a comparative thick paper board.

Furthermore, a conventional non-foldable packing box, such as a top and bottom type of packing box which has outer and inner boxes engaged with each other, can provide high weight capacity and aesthetic sensibility with comparatively low cost. A thick core board which is a conventional composite paper board having comparatively low price and high weight capacity is used to form a blank box with the fixed shape of packing box. Then, an inner layer paper and an outer layer paper are separately pasted to the inner surface and outer surface of the blank box. The edge of the outer layer paper is also pasted to the edge of the inner surface. The inner layer paper is pasted to the inner surface, and covers the edge of the outer layer paper to increase aesthetic sensibility of the packing box. However, since the core board is pasted after it is formed with the fixed shape, the pasting process needs complicated manual positioning, which results in low production efficiency and high product cost. Particularly, when the packing box has curve side edges, the operation of pasting is hard to implement.

SUMMARY OF THE INVENTION

An object of the present invention is to provide a method of making a foldable packing box, which can simplify the production flow thereby increasing production efficiency.

Another object of the present invention is to provide a method of making a foldable packing box, which can make full use of the materials, so as to avoid the waste of resource and reduce the cost.

To achieve the above mentioned objects, a method of making a foldable packing box of the present invention comprises the following steps:

step 1, making a pair of side boards with a side board body, two connecting parts foldably connected to the opposite sides of the side board body, and an installation part foldably connected to the side board body;

step 2, making a base board, step 2 including: step 2.1, providing a second core board in a predetermined shape with an outer layer paper being pasted at the outer surface of the second core board; step 2.2, spraying paint to the peripheral surface of the second core board; step 2.3, defining a plurality of parallel base board grooves at the inner surface of the second core board according to the size of the predetermined packing box, so as to separately form a plurality of folding lines at the base board;

step 3, respectively connecting the installation parts of the side boards to the opposite sides of the base board;

step 4, pasting inner layer paper to the inner surface of the second core board;

step 5, providing two fixing boards; and step 6, separately fixing the fixing boards to the base board, so as to produce a finished product of the foldable packing box.

Wherein step 1 includes: step 1.1, providing first core boards in a predetermined shape with an outer layer paper being pasted at the outer surface of the first core board; and step 1.2, making the first core board into a side board body, two connecting parts and an installation part foldable therebetween.

Wherein step 1.1 includes: first cutting the first core boards in the predetermined shape, and then pasting the outer layer paper in the same shape as the first core board to the outer surface of the first core board; or, first pasting the outer layer paper to the first core board material, and then cutting the first core board material in the predetermined shape.

Wherein step 1.2 includes: separately defining two parallel first grooves, a second groove that substantially vertically intersects the middle of the two first grooves, and a third groove that is parallel to the second groove and is close to one end of each first grooves at the inner surface of the first core board, according to the size of the predetermined side boards; and then folding the first core board in two along the second groove and combining the first board with glue, so as to form a side board body located between the two first grooves, two connecting parts located at the outside of the two first groove, and an installation part located at the outside of the third groove.

Wherein step 2.1 includes: first cutting the second core board in the predetermined shape, and then pasting the outer layer paper in the same shape as the second core board to the outer surface of the second core board; or, first pasting the outer layer paper to the second core board material, and then cutting the second core board material to form the second core board in the predetermined shape.

Wherein step 2.3 includes: defining four parallel base board grooves at the inner surface of the second core board, so as to form a first end board, a bottom board, a second end board, a cover board, and a fastening board.

Wherein the shape of the base board grooves in step 2.3 is preferably V-shaped or U-shaped.

Wherein in step 5, the inner layer paper is pasted to the side walls of the base board grooves; the thickness of the inner layer paper is thinner than the thickness of the outer layer paper.

Wherein step 5 includes: a comparatively thin and hard paper board in a predetermined shape being provided with two parallel folding lines according to the size of the packing box, so as to form a fixing part, a first abutting part, and a second abutting part that are connected in turn.

Wherein step 3 is implemented before step 4 so as to make the installation parts of the side boards to be fixed between the inner layer paper of the base board and the second core board; or step 4 is implemented before step 3 so as to make the installation parts of the side boards to be directly fixed to the inner layer paper of the base board.

The method of making a foldable packing box of the present invention improves the production method of the side boards and the base board, through pasting the outer layer paper in a plane before the core board is grooved, and spraying paint to decorate and protect the peripheral surface of the base board. Thus, the production process is simpler thereby greatly increasing the production efficiency. The method of separately making the side boards and the base board can save material thereby reducing the production cost.

The characteristic and the technical solution of the present invention are best understood from the following detailed description with reference to the accompanying figures, but the figures are only for reference and explaining, not to limit the scope of the invention.

BRIEF DESCRIPTION OF THE DRAWINGS

The technical solution and the beneficial effects of the present invention are best understood from the following detailed description with reference to the accompanying figures and embodiments.

DESCRIPTION OF THE PREFERRED EMBODIMENT

To further set forth the technical solution adopted by the present invention to achieve the predetermined objects and the effects, please read the following detailed description and figures according to the present invention; the objects, characteristics and novel features of the present invention will be best understood, but the figures are only for reference and explaining, not to limit the scope of the invention.

Figure 1:
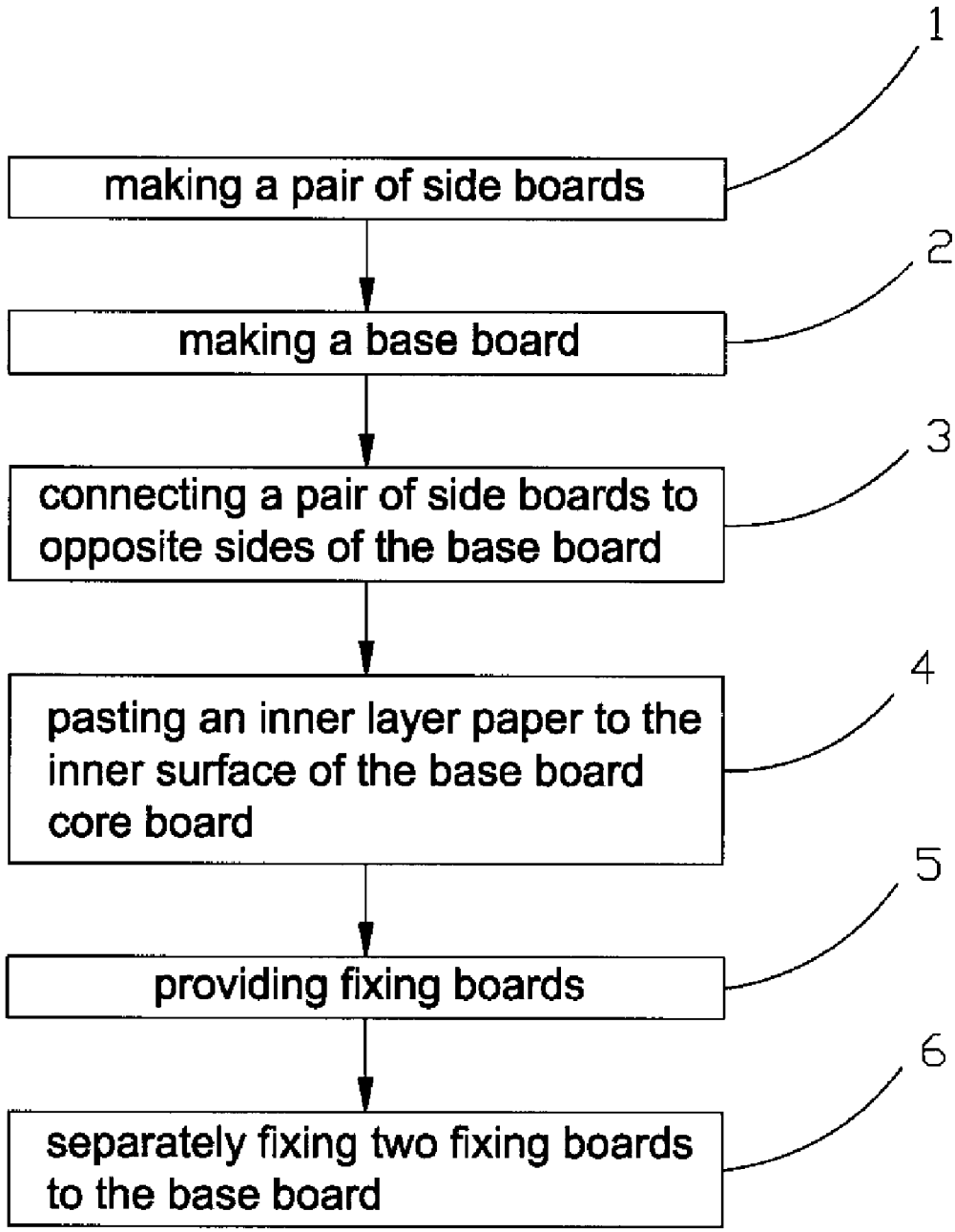
FIG. 1 is a flow chart of a method of making a foldable packing box of the present invention.
Figure 2:
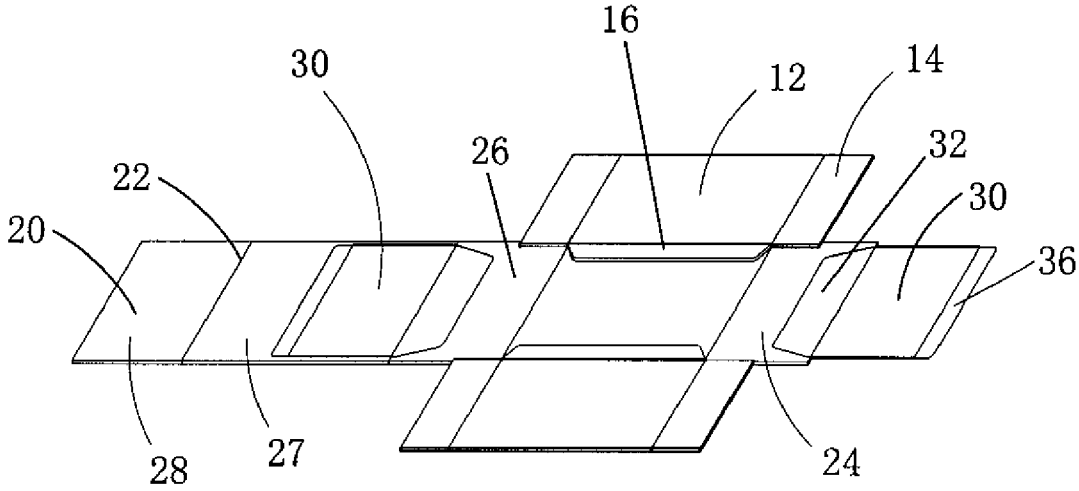
FIG. 2 is a perspective view showing a foldable packing box made by the method of the present invention being folded in a plane for saving space.
Figure 3:
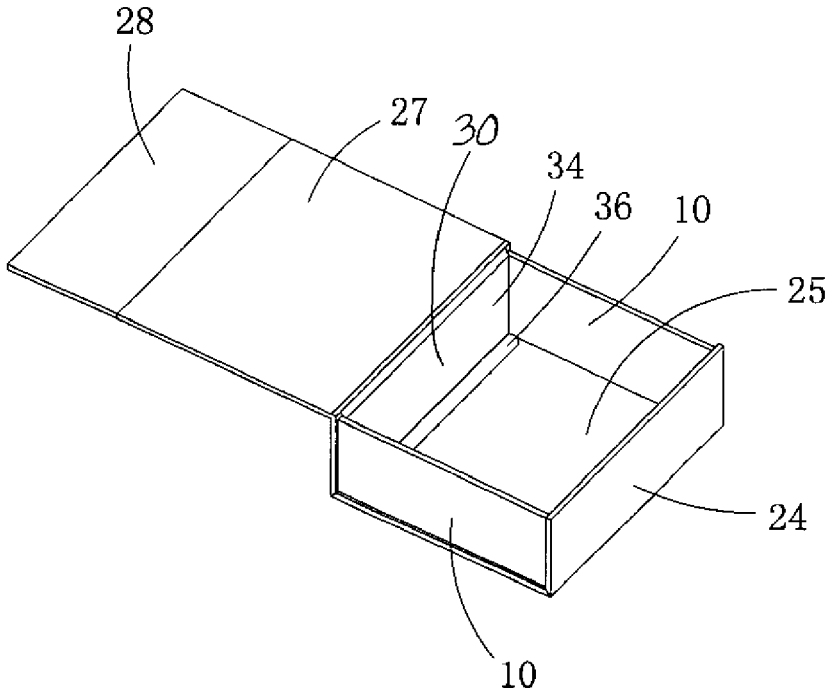
FIG. 3 is a perspective view showing a foldable packing box made by the method of the present invention being folded for use.

Referring to FIGS. 1-3, a method of making a foldable packing box of the present invention comprises the following steps.

Step 1, making a pair of side boards 10. Step 1 includes step 1.1, providing a pair of first core boards which each of has a predetermined shape and is pasted with an outer layer paper at the outer surface thereof. Two ways may be adopted to achieve step 1.1: one way is first cutting a first core board to be in a predetermined shape, and then pasting an outer layer paper formed in the same shape as the first core board to the outer surface of the first core board; the other way is first pasting an outer layer paper to a first core board material, and then cutting the first core board material to form the first core board in a predetermined shape. In step 1.1 of the present invention, the outer layer paper is pasted on the first core board in a plane, so the pasting operation is easy and quick and so is high efficient. The first core board is a common composite paper board which has a certain strength and toughness for affording a certain weight and is cheap for saving the manufacturing cost. The outer layer paper can be printed with patterns, texts and so on according to demands.

Step 1.2, making the first core board into a side board body 12, two connecting parts 14 and an installation part 16 which are foldable therebetween. Step 1.2 can be implemented specifically by separately defining two parallel first grooves, a second groove that substantially vertically intersects the middle of the two first grooves, and a third groove that is parallel to the second groove and is close to one end of each first groove, in the inner surface of the first core board, according to the size of the predetermined side boards 10, and then folding the first core board along the second groove in two and combining it with glue, so as to form a side board body 12 located among the two first grooves and the third groove, two connecting parts 14 located at the outsides of the two first grooves, and an installation part 16 located at the outside of the third groove. The first grooves and the third groove are all used to form folding lines for readily folding the connecting parts 14 and the installation part 16 relative to side board body 12. The shape and size of the first, second and third grooves are not limited, as long as the folding function can be implemented. In other embodiments, multiple grooves can also be defined to implement the same function. The intervals between the first, the second, and the third grooves are configured according to the size of the packing box.

Step 2, making a base board 20. Step 2 includes step 2.1, providing a second core board which has a predetermined shape and is pasted with an outer layer paper at the outer surface thereof. Two ways may be adopted to achieve step 2.1: one way is first cutting the second core board in a predetermined shape, and then pasting the outer layer paper in the same shape as the second core board to the outer surface of the second core board; the other way is first pasting the outer layer paper to the second core board material, and then cutting the second core board material to form the second core board in the predetermined shape. In step 2.1, the outer layer paper is pasted on the second core board in a plane, so the pasting operation is easy and quick, and so is high efficient. Particularly when the edge of the second core board is curve or non linear, step 2.1 can easily finish pasting compared with the conventional pasting operation as described in the background of the invention. The second core board is a common composite paper board which has a certain strength and toughness for loading a certain weight and is cheap for saving the manufacturing cost. The outer layer paper can be printed with patterns, texts, and so on according to demands.

Step 2.2, spraying paint to the peripheral surfaces of the second core board. A paint layer is formed at the peripheral surfaces of the second core board, so as to increase aesthetic sensibility, and to protect the section of the base board 20. The paint may have the same color as the outer layer paper. A batch of second core boards can be sprayed together. Therefore, the operation of spraying paint can replace the operation of pasting outer layer paper on the peripheral surface thereby increasing efficiency. Particularly when the edge of the second core board is non linear, the efficiency of pasting is low. So, the way of spraying paint can greatly increase the production efficiency.

Step 2.3, defining a plurality of parallel base board grooves 22 at the inner surface of the second core board according to the size of the packing box, to separately form a plurality of folding lines of the base board. In this embodiment, totally four parallel base board grooves 22 are defined, and the intervals between the grooves are configured according to the size of the packing box, so as to form a first end board 24, a bottom board 25, a second end board 26, a cover board 27, and a fastening board 28. The size of the first and the second end board 24, 26 is substantially the same, and the size of the bottom board 25 and the cover board 27 is substantially the same. The shape and size of the base board grooves 22 are not limited, as long as the folding function can be implemented.

In other embodiments, multiple grooves can also be defined to implement the same function. The shape of the base board grooves 22 is preferably V-shaped or U-shaped.

Step 3, connecting the pair of side boards 10 to the two sides of the bottom board 25 of the base board 20. In this step, the installation parts 16 of the side boards 10 are pasted to the two sides of the bottom board 25 with glue, and the two installation parts 16 are located close the side edges of the bottom board 25.

Step 4, pasting an inner layer paper to the inner surface of the second core board with the inner layer paper being pasted on the side walls of each base board groove 22. The thickness of the inner layer paper is comparatively thin, and is thinner than the thickness of the outer layer paper, for readily folding each part of the base board 20. As a selective embodiment, only part of the inner surface of the second core board is pasted with the inner layer paper to save the cost. For example, the inner layer paper is only pasted to the cover board 27 and the fastening board 28 of the second core board.

Step 5, making fixing boards 30. In step 5, a comparatively thin and hard paper board in a predetermined size is provided with two parallel folding lines being formed according to the size of the packing box, thereby forming a fixing part 32, a first abutting part 34, and a second abutting part 36 that are connected in turn. Step 5 can be implemented conventionally.

Step 6, separately fixing the two fixing boards 30 to the base board 20, thereby producing a finished product of the foldable packing box. Step 6 can be implemented conventionally.

To enable the fastening board 28 of the base board 20 to fasten to the first end board 24, the fastening board 28 and the first end board 24 can be separately provided with magnets or Velcros. Thus the fastening board 28 is fastenable to the first end board 24 by the magnets or a Velcro. The magnets or Velcros can be provided conventionally. For example, after step 2.3, step 2.4 is further comprised. In step 2.4, the magnets are separately mounted to the first end board 24 and the fastening board 28 correspondingly. Or after step 4, the Velcros are separately mounted to the first end board 24 and the fastening board 28.

In this embodiment, the installation parts 16 of the side boards 10 are fixed between the inner layer paper of the bottom board 25 and the second core board. As a selective embodiment of the present invention, the installation parts 16 of the side board 10 can be directly fixed to the inner layer paper of the bottom board 25. Thus, the step 3 can be implemented after step 4.

The order of each step of the method of making a foldable packing box of the present invention can be adjusted according to the requirement. For example, step 5 can be implemented beforehand.

The foldable packing box of the present invention can save the occupied space during storage and transportation, for reducing the cost of storage and transportation. In use, the two side boards 10 are only needed to be separately bended upwards, to make the side board body 12 vertical to the bottom board 25 of the base board 20, and then the four connecting parts 14 are all bended inwards, to make the connecting parts 14 vertical to both the side board body 12 and the bottom board 25. The first and second end boards 24, 26 are separately bended upwards to abut the four connecting parts 14. The fixing boards 30 are bended downwards and outwards separately, to make the first abutting part 34 to separately abut the inner surface of the four connecting parts 14, and make the second abutting part 36 to abut against the inner surface of the bottom board 25. The interferential engagement between the first abutting part and the side board body and between the second abutting parts and the bottom board 25 separately fixes the first and second end boards to the side boards 10, so as to form a cuboid box.

In summary, the method of making a foldable packing box of the present invention improves the production method of the side boards and the base board, through pasting the outer layer paper in a plane before the core board is grooved, and spraying paint to decorate and protect the peripheral surface of the base board. Thus, the production process is simpler thereby greatly increasing the production efficiency. The method of separately making the side boards and the base board can save material thereby reducing the production cost.

Although the present invention has been described in detail with above said embodiments, but it is not to limit the scope of the invention. So, all the modifications and changes according to the characteristic and spirit of the present invention, are involved in the protected scope of the invention.

What is claimed is:

1. A method of making a foldable packing box comprising the following steps:

step 1, making a pair of side boards with a side board body, two connecting parts foldably connected to the opposite sides of the side board body, and an installation part foldably connected to the side board body;

step 2, making a base board, step 2 including: step 2.1, providing a second core board in a predetermined shape with an outer layer paper being pasted at the outer surface of the second core board; step 2.2, spraying paint to the peripheral surface of the second core board; step 2.3, defining a plurality of parallel base board grooves at the inner surface of the second core board according to the size of the predetermined packing box, so as to separately form a plurality of folding lines at the base board;

step 3, respectively connecting the installation parts of the side boards to the opposite sides of the base board;

step 4, pasting inner layer paper to the inner surface of the second core board;

step 5, providing two fixing boards; and step 6, separately fixing the fixing boards to the base board, so as to produce a finished product of the foldable packing box.

2. The method of making a foldable packing box of claim 1, wherein step 1 includes: step 1.1, providing first core boards in a predetermined shape with an outer layer paper being pasted at the outer surface of the first core board; and step 1.2, making the first core board into a side board body, two connecting parts and an installation part foldable therebetween.

3. The method of making a foldable packing box of claim 2, wherein step 1.1 includes: first cutting the first core boards in the predetermined shape, and then pasting the outer layer paper in the same shape as the first core board to the outer surface of the first core board; or, first pasting the outer layer paper to the first core board material, and then cutting the first core board material in the predetermined shape.

4. The method of making a foldable packing box of claim 2, wherein step 1.2 includes: separately defining two parallel first grooves, a second groove that substantially vertically intersects the middle of the two first grooves, and a third groove that is parallel to the second groove and is close to one end of each first grooves at the inner surface of the first core board, according to the size of the predetermined side boards; and then folding the first core board in two along the second groove and combining the first board with glue, so as to form a side board body located between the two first grooves, two connecting parts located at the outside of the two first groove, and an installation part located at the outside of the third groove.

5. The method of making a foldable packing box of claim 1, wherein step 2.1 includes: first cutting the second core board in the predetermined shape, and then pasting the outer layer paper in the same shape as the second core board to the outer surface of the second core board; or, first pasting the outer layer paper to the second core board material, and then cutting the second core board material to form the second core board in the predetermined shape.

6. The method of making a foldable packing box of claim 1, wherein step 2.3 includes: defining four parallel base board grooves at the inner surface of the second core board, so as to form a first end board, a bottom board, a second end board, a cover board, and a fastening board.

7. The method of making a foldable packing box of claim 1, wherein the shape of the base board grooves in step 2.3 is preferably V-shaped or U-shaped.

8. The method of making a foldable packing box of claim 1, wherein in step 5, the inner layer paper is pasted to the side walls of the base board grooves; the thickness of the inner layer paper is thinner than the thickness of the outer layer paper.

9. The method of making a foldable packing box of claim 1, wherein step 5 includes: a comparatively thin and hard paper board in a predetermined shape being provided with two parallel folding lines according to the size of the packing box, so as to form a fixing part, a first abutting part, and a second abutting part that are connected in turn.

10. The method of making a foldable packing box of claim 1, wherein step 3 is implemented before step 4 so as to make the installation parts of the side boards to be fixed between the inner layer paper of the base board and the second core board; or step 4 is implemented before step 3 so as to make the installation parts of the side boards to be directly fixed to the inner layer paper of the base board.

* * * * *